US008376511B2

(12) United States Patent
Shimoda et al.

(10) Patent No.: US 8,376,511 B2
(45) Date of Patent: Feb. 19, 2013

(54) IMAGE FORMING APPARATUS

(75) Inventors: Tomohiko Shimoda, Amimachi (JP); Hiroshi Sugitani, Amimachi (JP); Naoki Akihiro, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 577 days.

(21) Appl. No.: 12/585,770

(22) Filed: Sep. 24, 2009

(65) Prior Publication Data

US 2010/0079545 A1 Apr. 1, 2010

(30) Foreign Application Priority Data

Sep. 30, 2008 (JP) ..... 2008-254891

(51) Int. Cl.
*B41J 2/165* (2006.01)

(52) U.S. Cl. ..... 347/34

(58) Field of Classification Search ..... 347/40, 347/43, 14, 34, 64–65
See application file for complete search history.

(56) References Cited

U.S. PATENT DOCUMENTS

| | | | | |
|---|---|---|---|---|
| 6,964,468 | B2 * | 11/2005 | Kitahara et al. | 347/42 |
| 8,042,918 | B2 * | 10/2011 | Hayashi | 347/70 |
| 2003/0128253 | A1 | 7/2003 | Kitahara et al. | |
| 2007/0103534 | A1 | 5/2007 | Shinohara et al. | |

FOREIGN PATENT DOCUMENTS

| | | | |
|---|---|---|---|
| JP | 2002-154196 | A | 5/2002 |
| JP | 2003-072055 | A | 3/2003 |
| JP | 2005-014487 | A | 1/2005 |
| JP | 2005-119284 | A | 5/2005 |
| JP | 2005-271314 | A | 10/2005 |
| JP | 2006-095779 | A | 4/2006 |
| JP | 2006-110987 | A | 4/2006 |
| JP | 2007-130761 | A | 5/2007 |
| JP | 2007-168278 | A | 7/2007 |
| JP | 2007-176002 | A | 7/2007 |
| JP | 2008-140766 | A | 6/2008 |

OTHER PUBLICATIONS

Official Action issued on Dec. 6, 2010, in counterpart Chinese application, four (4) pages.
Official Action issued on Nov. 6, 2012 in the counterpart Japanese application 2008-254891.

* cited by examiner

*Primary Examiner* — Lamson Nguyen
(74) *Attorney, Agent, or Firm* — Nath, Goldberg & Meyer; Jerald L. Meyer; Scott C. Langford

(57) ABSTRACT

An image forming apparatus for a printer forms images by injecting inks on a printing paper being fed on a feeding path. The image forming apparatus comprises a head holder surface provided on the feeding path with being opposed to a surface of the feeding path and a plurality of ink heads for injecting inks from injection ports thereof. Here, the injection ports of the plurality of ink heads are projected outward from the head holder surface. The image forming apparatus can achieve further downsizing and multifunctional capability and improve quality of higher pixelated printed images. In addition, the image forming apparatus can prevent negative effects such as ink injection failures or defacement of printed matters due to ink mists made on injecting ink.

11 Claims, 8 Drawing Sheets

IMAGE FORMING APPARATUS

BACKGROUND OF THE INVENTION

1. Field of the Invention

The present invention relates to an image forming apparatus, which is applied to a printing machine, such as an inkjet printer, and forms images by injecting ink drops onto a printing paper fed on a feeding path.

2. Description of Related Art

Among conventional inkjet printers, there is a full-line type inkjet printer by which printing is done only with a secondary sweeping in which a printing paper is fed along a feeding direction (Patent document 1: Japanese Patent Application Laid-Open No. 2002-154196). In such a full-line type inkjet printer, printing of one entire line of text onto the paper is successively executed.

Recently, various requirements are made to a printer, such as handling of higher pixelated printing images, further multifunctional capability, further downsizing and so on. To meet the requirements, it is needed to locate highly condensed ink heads closely each other. If unnecessary ink drops (mists) are made other than main ink drops injected from an ink head, the mists can't reach to a printing sheet because of their relatively small mass and low speed. Then the mists float in the air and then may directly attach on other ink heads or a head holder. As a result, injection ports on the ink heads are occluded and then injection failures may occur, such as absence of injected ink and lack of injected ink amount. In addition, if the inks attaching and then growing within the printer drop off onto a fed paper or a feeding belt due to self-weight thereof, printed matters may become tainted.

To solve the above problems, a technique is proposed in the Patent Document 1. According to the technique, the mists are prevented from attaching onto the other ink heads or the head holder by securing a predetermined distance or more between the ink heads adjacent in a feeding direction.

However, according to the technique in the Patent Document 1, the printer must ensure length in the feeding direction and then the printer itself may become large. In addition, the mists may infiltrate into the inside of the printer and attach onto other functional components due to the distance secured between the highly condensed ink heads and thereby unexpected negative effects may occur.

SUMMARY OF THE INVENTION

The present invention has been achieved in order to solve the above problems and an object of the present invention is to provide an image forming apparatus that can achieve further downsizing and multifunctional capability and improve quality of higher pixelated printed images. In addition, the image forming apparatus can prevent negative effects such as ink injection failures or defacement of printed matters due to ink mists made on injecting ink.

An aspect of the present invention provides an image forming apparatus for a printer which forms images by injecting inks on a printing paper being fed on a feeding path. The apparatus comprises a head holder surface provided on the feeding path with being opposed to a surface of the feeding path and a plurality of ink heads for injecting inks from injection ports thereof. Here, the injection ports of the plurality of ink heads are projected outward from the head holder surface.

According to the aspect of the present invention, in a printer having plural ink heads, the ink heads can be fixed with high precision by projecting the ink heads outward from the head holder surface. In addition, since spaces between the ink heads are covered by the head holder surface, it is prevented that ink mists infiltrate into the inside of the printer and attach onto other functional components.

It is preferable that the plurality of the ink heads is aligned along a direction (primary sweeping direction) perpendicular to the feeding direction (secondary sweeping direction) to form a plurality of columns. The plurality of the ink heads is aligned in a staggered manner. The plurality of columns is aligned at predetermined intervals to form primary flow paths therebetween so as not to overlap each other. The primary flow paths extend along the direction perpendicular to the feeding direction. The ink heads in each column are aligned at predetermined intervals to form secondary flow paths therebetween so as to overlap the ink heads in the each column with the ink heads in other columns adjacent to the each column along the feeding direction. The primary flow paths and the secondary flow paths are communicated with each other to form retiform mist eduction paths.

According to the above configuration, the ink heads are aligned so as to form spaces therebetween along the primary and secondary sweeping directions. Therefore, the primary and secondary flow paths can be ensured as airflow paths for ink mists made on printing. The ink mists can be ejected through any of the primary and secondary flow paths. As a result, it can be prevented that the ink heads and the head holder are contaminated by the ink mists attaching thereon.

It is preferable that a projecting height H of the plurality of the ink heads from the head holder surface is made larger than a width L of the primary flow paths. According to the above configuration, spaces can be ensued between the ink injection plane of the ink heads and the head holder surface. Ink mist injected from the ink heads can be diffused through the spaces and thereby it can be prevented that the ink mists attach onto the head holder and the ink heads. In addition, the spaces can be ensured to extend along both of the feeding direction and the height direction and thereby further downsizing of the printer can be achieved.

It is preferable that a plurality of guide rollers is provided in the primary flow paths. The plurality of guide rollers is positioned upstream the plurality of ink heads along the feeding direction, respectively, and rotated with being pressed onto an upper surface of the feeding path. According to the above configuration, a printing paper can be held between the guide rollers and the upper surface of the feeding path because the guide rollers rotate with being pressed onto the upper surface of the feeding path. Therefore, the printing paper is pressed downward by the guide rollers provided just upstream the ink heads and thereby the printing paper is held firmly by the guide rollers just before being printed with inks to be injected from the ink heads. As a result waving of the printing paper can be prevented and thereby printed images can obtain higher pixelated quality. In addition, since contacts between image forming units such as the ink heads and the printing paper can be prevented, the ink heads are protected.

It is preferable that the apparatus further comprises an ink head holder having the head holder surface at its bottom face. Here, the plurality of ink heads is held by the ink head holder with the injection ports being projected outward from the head holder surface. In addition, the plurality of guide rollers is rotatably supported by the ink head holder. According to the above configuration, alignments between the ink heads and the guide rollers can be fixed with high precision because the ink heads and the guide rollers are held by the ink head holder. In addition, it can be prevented that the ink heads contact with the guide rollers when attaching or detaching the ink heads and thereby the ink heads are protected.

It is preferable that the apparatus further comprises a belt provided along the feeding path for feeding a printing paper. Here, an upper surface of the belt is opposed to the head holder surface and a plurality of belt holes are formed on the belt. The printing paper is suctioned on the upper surface of the belt due to negative pressure generated beneath the belt via the plurality of belt holes.

According to the above configuration, the printing paper can be suctioned on the belt due to negative pressure generated beneath the belt via the plurality of belt holes. In addition, airflows for ejecting/diffusing the ink mist can be generated in the primary airflow paths via the belt holes that are not covered by the printing paper.

As described above, according to the present invention, further downsizing and multifunctional capability can be achieved and quality of higher pixelated printed images can be improved in a printer which forms images by injecting inks on a printing paper being fed on a feeding path, such as an inkjet printer. In addition, negative effects can be prevented such as ink injection failures or defacement of printed matters due to ink mists made on injecting ink.

BRIEF DESCRIPTION OF THE DRAWINGS

FIG. 3A is a schematic diagram showing an underside of a head holder provided above the image forming path from;

DETAILED DESCRIPTION OF THE EMBODIMENTS

General Configuration of Printer

Figure 1A:
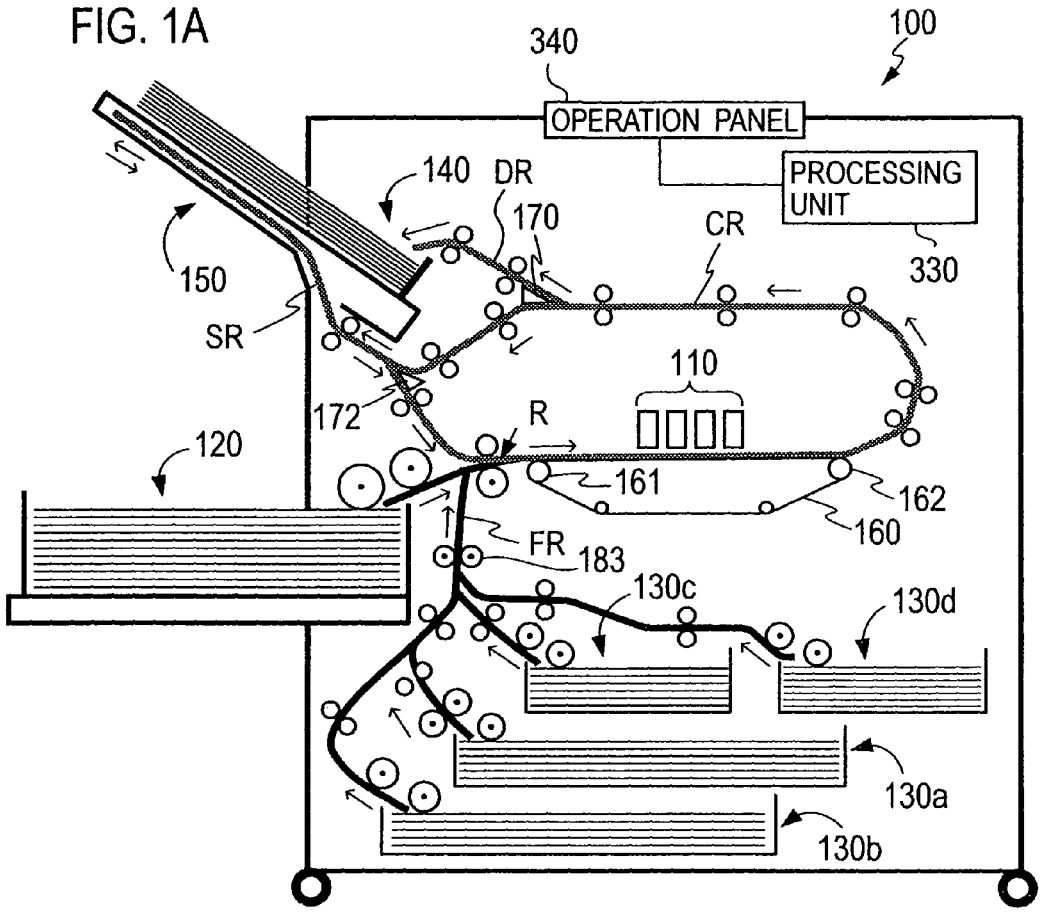
FIG. 1A is a configuration diagram showing a general outline of a feeding path of printing papers in a printer (an image forming apparatus) according to an embodiment of the present invention.

One embodiment of an image forming apparatus according to the present invention will be explained hereinafter. As shown in FIG. 1A, a printer 100 (the image forming apparatus) is an inkjet type color line printer. The printer 100 includes a plurality of ink heads 110*a* (head units 110) each has a number of nozzles. Printing is done line by line by ejecting black and/or color ink drops from the nozzles onto a printing paper (sheet) on a feeding belt so as to overlap images each other.

The printer 100 is an apparatus for forming images on a surface of a printing paper fed along a circular feeding path. The image forming path is mainly composed of paper feed paths FR for supplying printing papers, a main path CR extending from the paper feed paths FR to a paper ejection path DR via head units 110, and a reversing path SR branched from the main path CR.

On the paper feed paths FR, a paper feed side shelf 120 provided outside of a cabinet and paper feed trays 130 (130*a* to 130*d*) provided within the cabinet are equipped as a paper feed mechanism for feeding printing papers. A paper ejection port 140 is provided as a paper ejection mechanism for ejecting printed printing papers.

A printing paper (sheet), which is supplied from any one of the paper feed side shelf 120 and the paper feed trays 130, is fed along the paper feed path FR within the cabinet by a drive mechanism such as rollers and led to a registry position R which is a reference position for a leading edge of the printing paper. The head units 110 each having a printing head are provided at a further downstream position from the registry position R in a feeding direction. Images are formed line by line on the printing paper due to inks injected from the ink heads 110*a* while the printing paper is fed by a platen belt (feed belt) 160 provided oppositely to the head units 110 with a speed that is set according to a printing condition.

The printed printing paper is further fed along the main path CR by the drive mechanism such as rollers. In a case of one-side printing for printing on only one surface of the printing paper, the printing paper is ejected from the paper ejection port 140 via the ejection path DR and stacked on an ejected paper tray 150 provided as a receiving shelf with its printed surface being down-faced. The ejected paper tray 150 has a tray shape extending outward from the cabinet and has some degrees of thickness. The ejected paper tray 150 is inclined and ejected papers are aligned spontaneously to be stacked due to a wall formed at the lowest position of the inclined ejected paper tray 150.

On the other hand, in a case of double-side printing for printing on both surfaces of the printing paper, the printing paper is not led to the ejection path DR after printing on a front surface (a firstly printed surface is defined as a "front surface" and a next printed surface is defined as a "back surface") and fed further within the cabinet to the reversing path SR. The printer 100 includes a reversing mechanism 170 to change over feed paths for a reverse printing. The printing paper that was not fed to the ejection path DR due to the reversing mechanism 170 is drawn to the reversing path SR.

By the reversing path SR, the printing paper is reversed while the printing paper is received from the main path CR by feeding back and forth. This operation is so-called a switchback. Subsequently, the printing paper is retuned to the main path CR by the drive mechanism such as rollers via a switchover mechanism 172 and fed again from the registry position R for printing on the back surface by the same processes as printing on the front surface. After printing on the back surface, the printing paper with images being printed on its both surfaces is led to the paper ejection port 140 via the ejection path DR and ejected onto the ejected paper tray 150 provided as the receiving shelf of the paper ejection port 140. The ejected printing papers are stacked on the ejected paper tray 150.

Note that, in the present embodiment, the switchback in the double-side printing is done using a space within the ejected paper tray 150. The space within the ejected paper tray 150 is configured to be covered for preventing the printing paper from being brought out during the switchback. This configuration prevents the printing paper being reversed from being drawn away accidentally by a user. In addition, since the ejected paper tray 150 is inherently provided on the printer 100, it is not needed to provide a special independent space for the switchback within the printer 100 due to the efficient use of the space within the ejected paper tray 150 for the switchback. Further, since the ejection path DR and the reversing path SR are not shared, the switchback operation and the paper ejection of another printing paper can be done in parallel.

During double-side printing in the printer 100, the printing paper that has been already printed on its one surface is fed to the registry position R of the reference position for a leading edge of a fed printing paper. Therefore, a confluent point C at which a feed path for a newly fed printing paper and a re-feed path for a recirculated printing paper to be printed on its back surface is formed at just upstream the registry position R. A printing paper is fed from the registry position R in vicinity of the confluent point C of the paper feed paths FR and the main path CR.

Figure 1B:
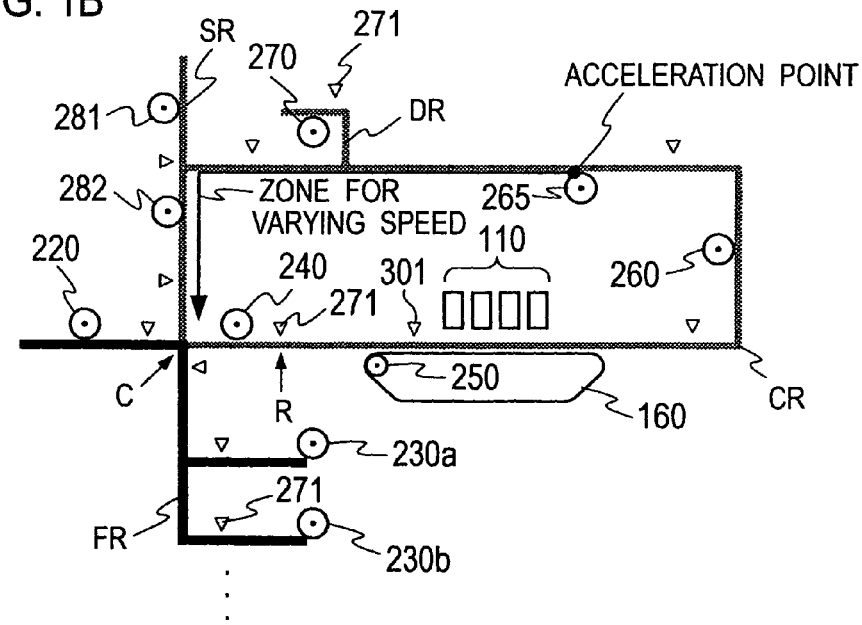
FIG. 1B is a schematic diagram showing paper feed paths FR, a main path CR and a reversing path SR.

In the present embodiment, when the confluent point C is defined as a reference point, paths located in the side of the paper feed mechanism are defined as the paper feed paths FR and a path other than the paper feed paths FR is defined as the feeding path. The feeding path is circular and includes the main path CR and the reversing path SR as mentioned above. FIG. 1B schematically shows the main path CR and the reversing path SR. Note that some of the rollers that compose the drive mechanism are omitted to be drawn in the FIG. 1B, so that the number of the rollers in FIG. 1B is not necessarily accurate.

On the paper feed paths FR, equipped are a side paper feed drive unit 220 for feeding printing papers from the paper feed side shelf 120 and tray drive units 230*a*, 230*b* . . . for feeding printing papers from the paper feed trays 130 (130*a* to 130*d*). A paper feed unit for feeding printing paper to the registry position R is composed of these components.

Further, any of the tray drive units 230*a*, 230*b* . . . on the paper feed paths FR also includes a drive mechanism composed of rollers or the like and draws a printing paper one by one from printing papers stacked on the paper feed side shelf 120 or the paper feed trays 130 to feed the printing paper toward the registry position R. Each of the drive units can be driven independently according to the paper feed mechanism that is going to feed a printing paper.

Figure 2:
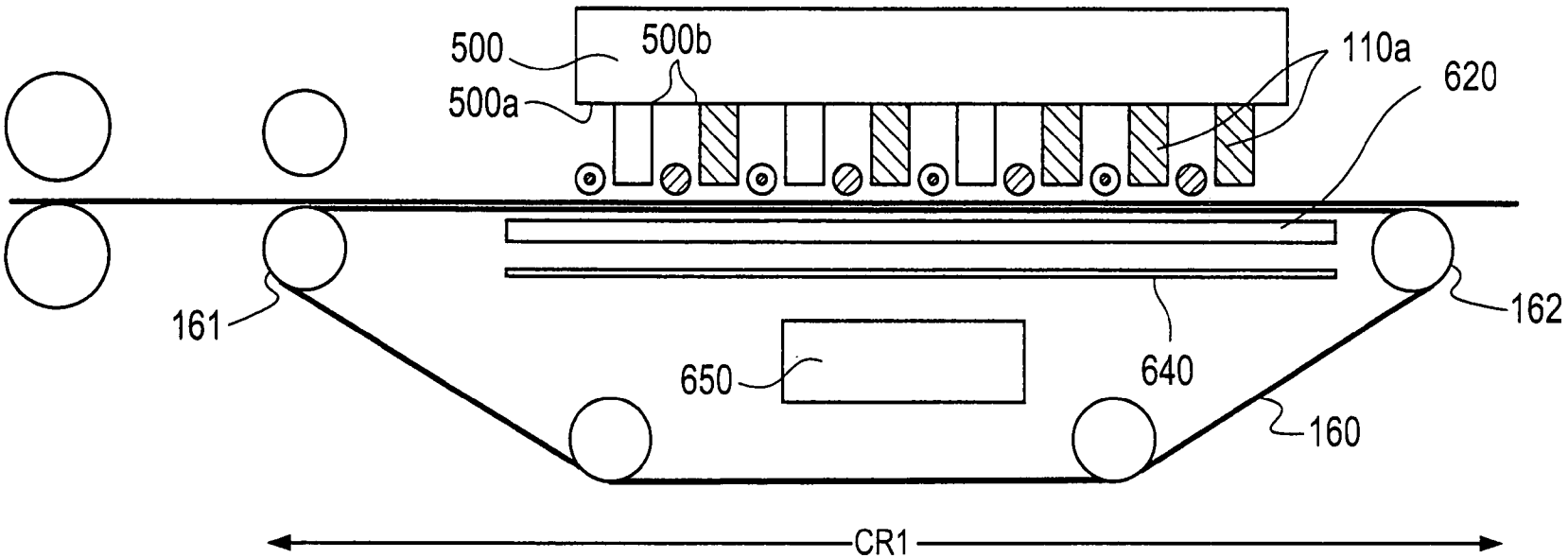
FIG. 2 is a schematic diagram showing an image forming path from its side.

As shown in FIG. 2, plural feed sensors 271 are provided on the paper feed paths FR to detect paper jams on the paper feed paths FR. Namely, each of the feed sensor 271 is a sensor for detect absence or presence of a printing paper or to detect a leading edge of a printing paper. For example, the feed sensors 271 are provided at appropriate intervals on the feeding path and it is determined that a paper jam occurs when a printing paper is not detected by a downstream sensor 271 within a predetermined duration time from the time of detecting the printing paper by an upstream feed sensor 271.

A registry sensor 271, which is one of these feed sensors 271, is located at the registry position R from which a printing paper is fed out (or, at just before the registry position R). The registry sensor 271 also measures a paper size of a printing paper being fed. For example, the registry sensor 271 measures a paper size of a paper passing through based on a passing velocity and a passing time. The registry sensor 271 can determine that a paper jam (a feed error) occurs when a printing paper is not detected by a feed sensor 271 within a predetermined duration time from the time of starting to drive the side paper feed drive unit 220 or the tray drive units 230*a*, 230*b* and so on.

The main path CR composes a part of a circular feeding path. The main path CR is a path from the paper feed paths FR for feeding printing paper to the ejection path DR via the head units 110. Images are formed on an upper surface of a printing paper within the main path CR. On the main path CR, a registry drive unit 240 for feeding a printing paper to the registry position R, a belt drive unit 250 for endlessly driving the platen belt 160 provided oppositely against the head units 110, first and second upper feed units 260 and 265 provided in sequence along a feeding direction, an upper ejection drive unit 270 for leading a printed printing paper to the ejection port 140, and a drive unit for drawing a printing paper into the reversing path SR. Each of the drive units can be driven independently according to feeding conditions of a printing paper.

Further, plural feed sensors 271 are provided on the main path CR to detect paper jams on the main path CR. Furthermore, proper feedings of printing papers can be confirmed at the registry position R. On the main path CR, the feed sensors 271 are provided with being associated with the drive units, respectively. Therefore, it can be specified that a paper jam occurs at which drive unit on the main path CR.

The reversing path SR is connected to the main path CR with being branched. The reversing path SR is a path and a feed mechanism for receiving a printing paper from the main path CR and bringing back the printing paper to the main path CR after reversing the printing paper by feeding back and forth (by the switchback). On the reversing path SR, equipped is a reverse drive unit 281 for leading a printing paper to the confluent point C after reversing the printing paper. In addition, feeding on the reversing path SR can be done with a different speed from a speed on the main path CR. Therefore, a feeding speed on the reversing path SR can be accelerated or decelerated when a printing paper is drawn from the main path CR. Further, a detention time at the switchback can be prolonged or shortened by controlling the feeding speed on the reversing path SR.

In the present embodiment, after feeding a leading printing paper, next feeding of another following printing paper is started not after the ejection of the printing paper that has been printed but before the ejection of the printing paper due to scheduling. Therefore, printing can be done successively at predetermined time intervals. Under a normal for double-side printing, a space is preliminarily secured for a printing paper to be brought back from the reversing path SR when feeding a printing paper to be printed on its front surface. According to the printer 100 in the present embodiment, printing for a front surface and printing for a back surface can be processed in parallel and thereby efficiency can be improved twice as much as one-side printing.

The platen belt 160 is placed around a drive roller 161 and a driven roller 162. The drive roller 161 is provided at a front end of a plane opposed with the head units 110 and the driven roller 162 is provided at a rear end of the plane. The platen belt 160 rotates clockwise in FIGS. 1A and 1B. The four ink heads 110*a* (head units 110) are provided above an upper plane of the platen belt 160 along a moving direction of the platen belt 160 so as to form a color image by overlapping images each formed by the respective head units 110.

In addition, the printer includes an arithmetic processing unit 330 as shown in FIG. 1. The processing unit 330 is a processing module composed of processors such as a CPU, a DSP (Digital Signal Processor) and so on, memories, other hardwares such as electronic circuits, softwares such as programs implementing functions of the above-mentioned components, or combinations thereof. The processing unit 330 virtually builds various functional modules by arbitrarily loading and executing programs. The processing unit 330 also executes processes of image data, controls of components' operations and various processes against user's operations using the built functional modules. Further, an operation panel 340 is connected to the processing unit 330. User's instructions and setting operations can be accepted via the operation panel 340.

(Feed Mechanism on Image Forming Path)

As shown in FIG. 2, the main path CR includes an image forming path CR1 composed of the platen belt 160, the drive roller 161, the driven roller 162 and so on. A head holder 500 is provides above the image forming path CR1. The head holder 500 is a case having a head holder surface 500*a* at its bottom face. The head holder 500 holds/fixes the ink heads 110*a* and unitizes other components for injecting inks from the ink heads 110*a* to house them therein.

The head holder surface 500*a* is arranged oppositely and parallely to the feed path. Attachment openings 500*b* each has the same shape as a horizontal cross-sectional shape of the ink heads 110*a* are arrayed on the head holder surface 500*a*. The ink heads 110*a* are inserted into the attachment openings 500*b*, respectively, and project their injection ports from the attachment openings 500*b*. Although the ink heads 110*a* are projected from the head holder surface 500*a* in the present embodiment, they can be fixed by other methods as long as the injection ports are located outward from the head holder surface 500*a*.

Figure 4A:
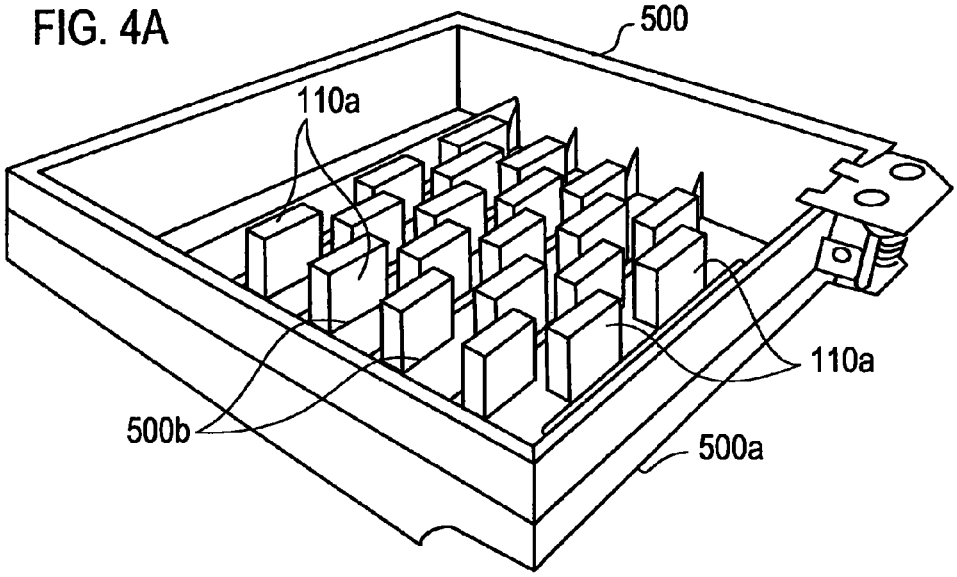
FIG. 4A is a bird's-eye perspective view of the head holder.
Figure 4B:
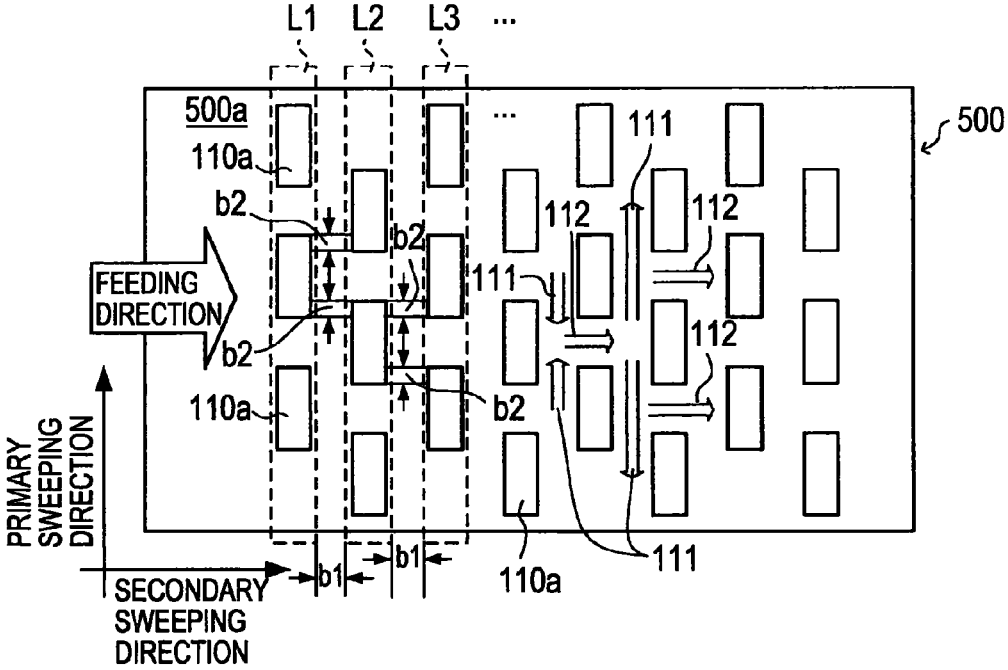
FIG. 4B is a schematic diagram showing the underside of the head holder.

As shown in FIG. 4B, the ink heads 110*a* are aligned along a direction (primary sweeping direction) perpendicular to the feeding direction (secondary sweeping direction) to form columns L1, L2, L3, . . . . Segments b1 are formed between the columns L1, L2, L3, . . . not to overlap the columns L1, L2, L3, . . . each other. In addition, segments b2 are formed in each of the columns L1, L2, L3, . . . along the feeding direction (secondary sweeping direction) to overlap its ink heads 110*a* with the ink heads 110*a* in the adjacent columns. Therefore, the ink heads 110*a* are aligned in a staggered manner to form the segments b2. Note that, in the present embodiment, the primary sweeping is done by moving the ink heads 110*a* (head units 110) and the secondary sweeping is done by feeding the printing paper (sheet) relative to the ink heads 110*a*.

Figure 3A:
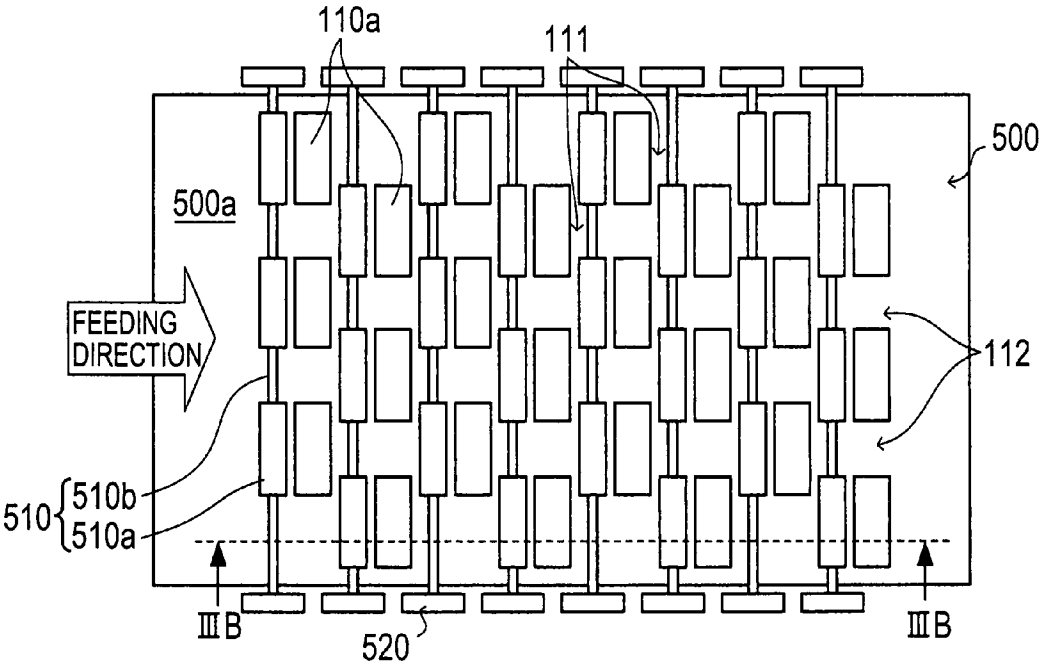
Figure 3B:
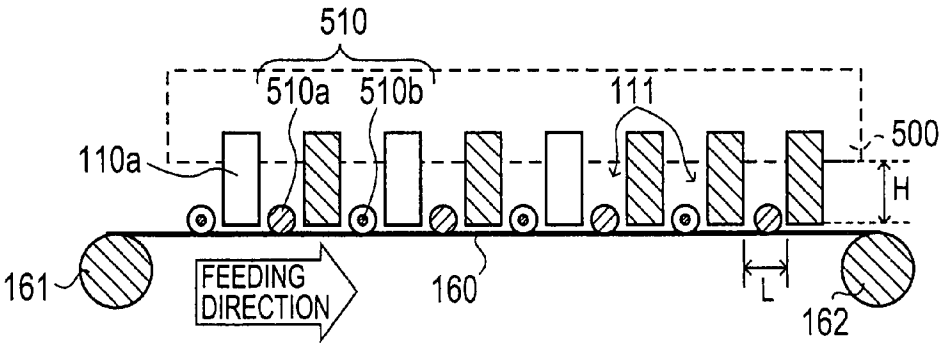
FIG. 3B is an enlarged schematic side view of the head holder.

In addition, the columns L1, L2, L3, . . . are aligned along the feeding direction at predetermined intervals. Primary flow paths 111 are made between the columns. In each of the columns, the ink heads 110*a* are aligned at predetermined intervals to form secondary flow paths 112 therebetween. The primary flow paths 111 and the secondary flow paths 112 are communicated with each other to form retiform mist eduction paths. Note that the projecting height H of the ink heads 110*a* from the head holder surface 500*a* is made larger than the width L of the primary flow paths 111 to ensure the spatial height of the mist eduction paths in the present embodiment, as shown in FIG. 3B.

Further, a stepped guide roller 510 is provided in each of the primary flow paths 111. The stepped guide roller 510 is made by integrating rollers that have different outer diameters alternately so as to form one integrated roller. For example, the stepped guide roller 510 is made by grinding a metal rod. Specifically, the stepped guide roller 510 includes upstream guide rollers 510*a* each having a large outer diameter and downstream guide rollers 510*b* each having a smaller outer diameter than the large outer diameter of the upstream guide rollers 510*a*. The stepped guide roller 510 is formed by integrating the upstream guide rollers 510*a* and the downstream guide rollers 510*b* alternately on a single rotational axis. The upstream guide rollers 510*a* are located upstream of the ink heads 110*a* along the feeding direction, respectively. The upstream guide rollers 510*a* are urged downward to rotate with being pressed onto the upper plane of the feeding path. On the other hand, the downstream guide rollers 510*b* are located downstream of the ink heads 110*a* along the feeding direction, respectively. The downstream guide rollers 510*b* are rotatably supported with being made distanced from the upper plane of the feeding path.

In relation to the staggered alignment of the ink heads 110*a*, the upstream guide rollers 510*a* and the downstream guide rollers 510*b* are also aligned in a staggered manner. Since the stepped guide roller 510 is provided in each of the primary flow paths 111, the upstream guide rollers 510*a* and the downstream guide rollers 510*b* are consequently provided alternately in each of the primary flow paths 111. Note that each of the stepped guide rollers 510 is rotatably supported by bearings 520 provided at both side of the head holder surface 500*a* and thereby integrally installed on the head holder 500 in the present embodiment, as shown in FIG. 3A.

Figure 5:
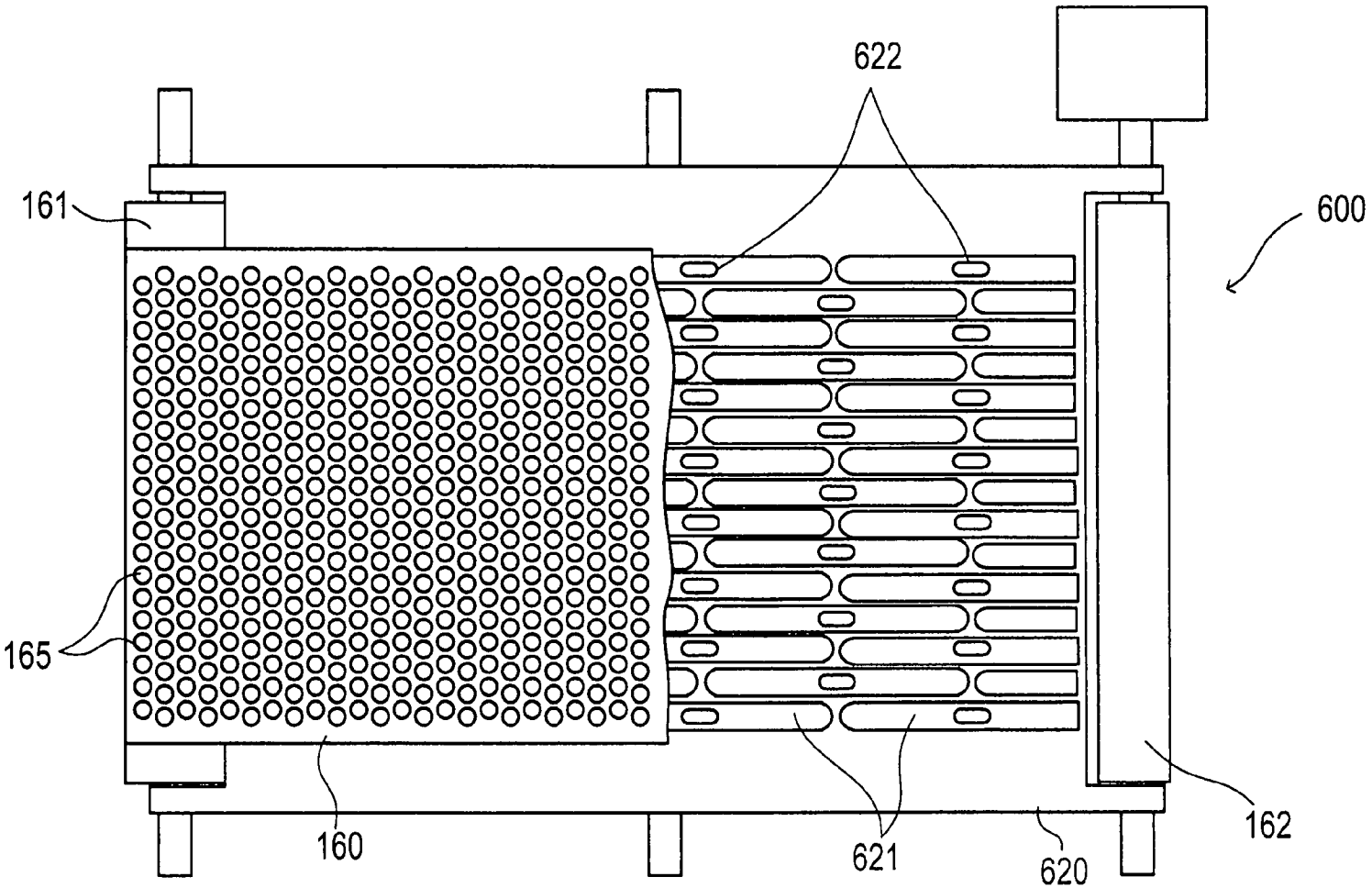
FIG. 5 is a plan view showing a paper feed mechanism (partially cut away) on the image forming path.

Next, the paper feed mechanism on the image forming path CR1 will be explained hereinafter. As shown in FIG. 5, the platen belt 160, the drive roller 161, the driven roller 162 and a platen plate 620 are provided on the image forming path CR1.

A number of belt holes 165 are formed on the platen belt 160 to suction a printing paper. The platen belt 160 is a continuous loop belt member that slides within a range opposing the ink heads 110*a* to feed a printing paper. Specifically, the platen belt 160 is placed around the drive roller 161 and the driven roller 162 that are provided along a direction perpendicular to the feeding direction. The platen belt 160 is made rotated by the drive roller 161 in the feeding direction.

The platen plate 620 is a plate member and slidably supports the upper segment of the platen belt 160 at the range opposing the ink heads 110*a*. A number of suction holes 622 are formed on the platen plate 620 within a range where the belt holes 165 pass through. As shown in FIG. 2, a suction fan 650 is provided beneath the platen plate 650 to generate negative pressure for suctioning a printing paper on the upper surface of the platen belt 160 via the suction holes 622 and the belt holes 165.

In addition, each of the suction holes 622 is enlarged toward the upper surface of the platen plate to form a recess 621 on the upper surface of the platen plate 620. The recesses 621 are communicate with the suction holes 622, respectively. In the present embodiment, each of the recesses 621 is formed independently from the adjacent recesses 621 to form a number of segmented tiny spaces on the platen plate 620. These tiny spaces are aligned in a staggered manner not to be coincident with adjacent other tiny spaces in a direction perpendicular to the feeding direction. Although the staggered arrangement is employed not to be coincident in the present embodiment, areas, volumes or locations of the recesses may be varied alternately.

(Prevention of Mist Attaching by Head Holder Surface)

In the present embodiment, mist generated at ink injection is prevented from attaching other functional components by the head holder surface 500*a*.

As explained above, the ink heads 110*a* are held at the head holder surface 500*a* of the head holder 500 in the present embodiment. Therefore, spaces between the ink heads 110*a* are covered by the head holder surface 500*a* to prevent mists from infiltrating into spaces between the ink heads 110*a* or the inside of the printer 100. Therefore, it can be prevented that mists attach onto other functional components.

Especially, the projecting height H of the ink heads 110*a* from the head holder surface 500*a* is made larger than the width L of the primary flow paths 111 in the present embodiment as explained above.

Figure 6A:
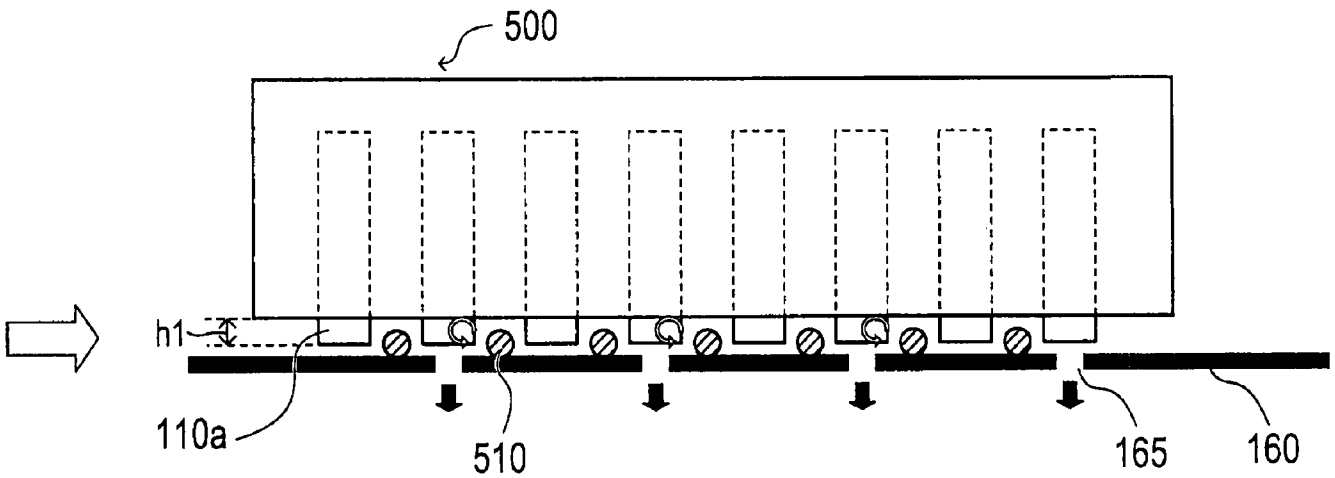
FIG. 6A is a schematic diagram showing air flows around the ink heads when the head holder surface is placed low.
Figure 6B:
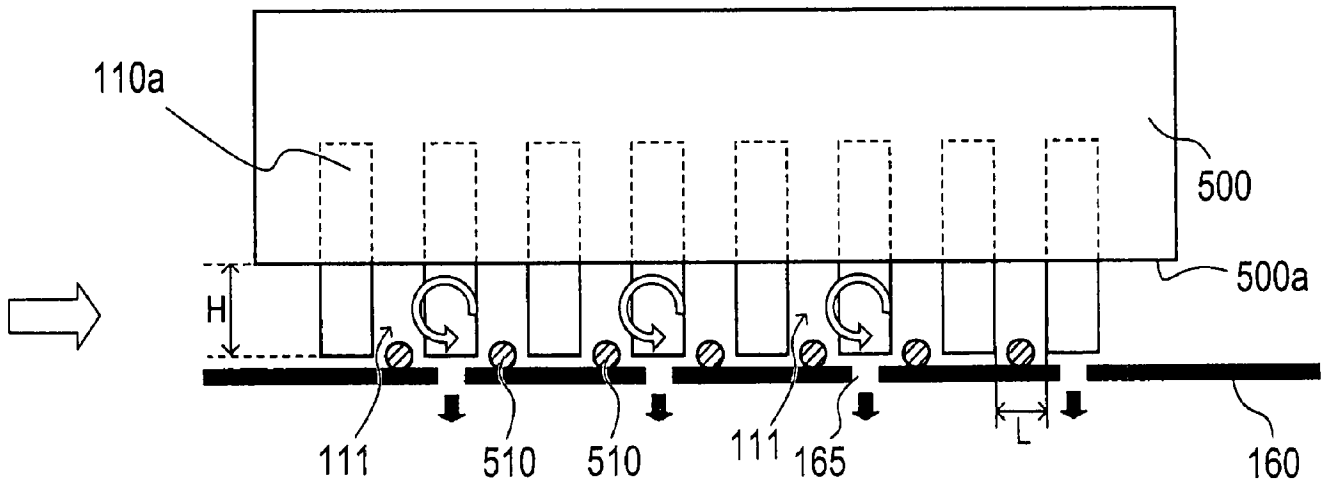
FIG. 6B is a schematic diagram showing air flows around the ink heads when the head holder surface is placed high.

As shown in FIG. 6A, when the projecting height h1 of the ink heads 110*a* is made smaller than the width L of the primary flow paths 111, spaces surrounded by the head holder surface 500*a*, side surfaces of the adjacent ink heads 110*a* and the upper surface of the platen belt 160 become narrow. Mists within such a narrow space are raised by the stepped guide rollers 510. Rotational radius of swirls of the raised mists is small and thereby attenuation of airflows becomes pronounced due to viscosity resistance of the swirls. As a result, the raised mists easily attaches onto surfaces around the ink heads 110*a* and the head holder surface 500*a*. On the contrary, as shown in FIG. 6B, the projecting height H of the ink heads 110*a* is made larger than the width L of the primary flow paths 111 according to the present embodiment. Therefore, the spaces can be sufficiently enlarged and thereby rotational radius of swirls of the mists raised by the stepped guide rollers 510 becomes large. Therefore, the mists are diffused by airflows and prevented from stagnating intensively around the ink heads 110*a*.

Further, the retiform mist eduction paths are formed on the head holder surface 500*a* by the ink heads 110*a* aligned in a staggered manner.

Figure 7A:
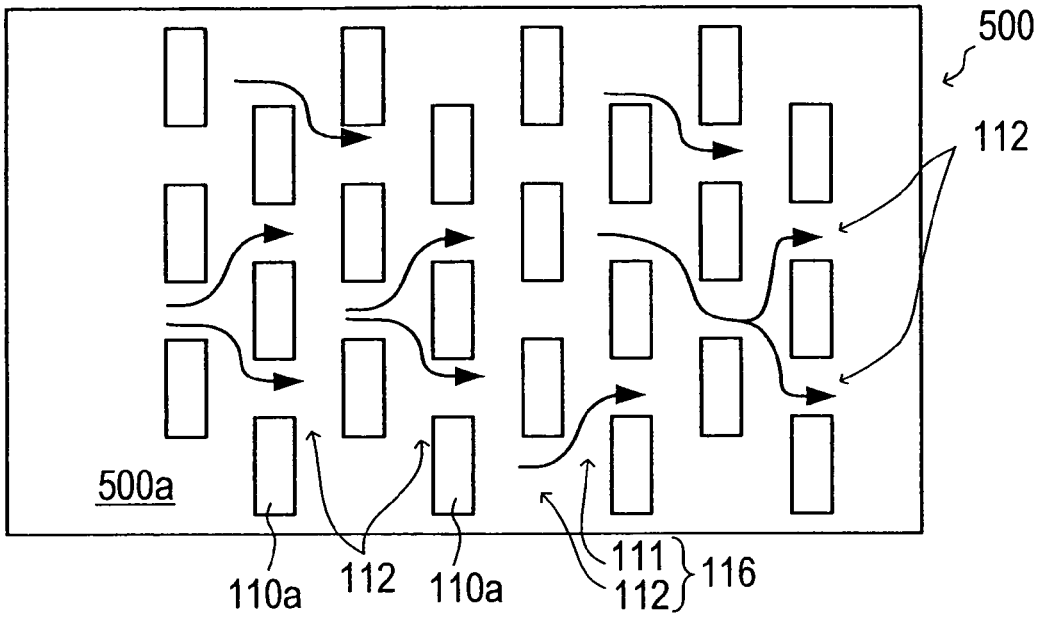
FIG. 7A is a schematic diagram showing ink mist flows around the ink heads viewed from beneath the head holder.

As shown in FIG. 7A, each column of the ink heads 110*a* is aligned at a predetermined intervals in the feeding direction to form the primary flow paths 111 therebetween. In each column, the ink heads 110*a* are aligned at predetermined intervals to form the secondary flow paths 112 therebetween. As a result, the primary flow paths 111 and the secondary flow paths 112 are communicated each other to form the retiform mist eduction paths 116. Both ends of the ink heads 110*a* are overlapped with those of the ink heads 110*a* in the adjacent columns (see b2 in FIG. 4B). The secondary flow paths 112 are aligned so as no to overlap each other.

Figure 8:
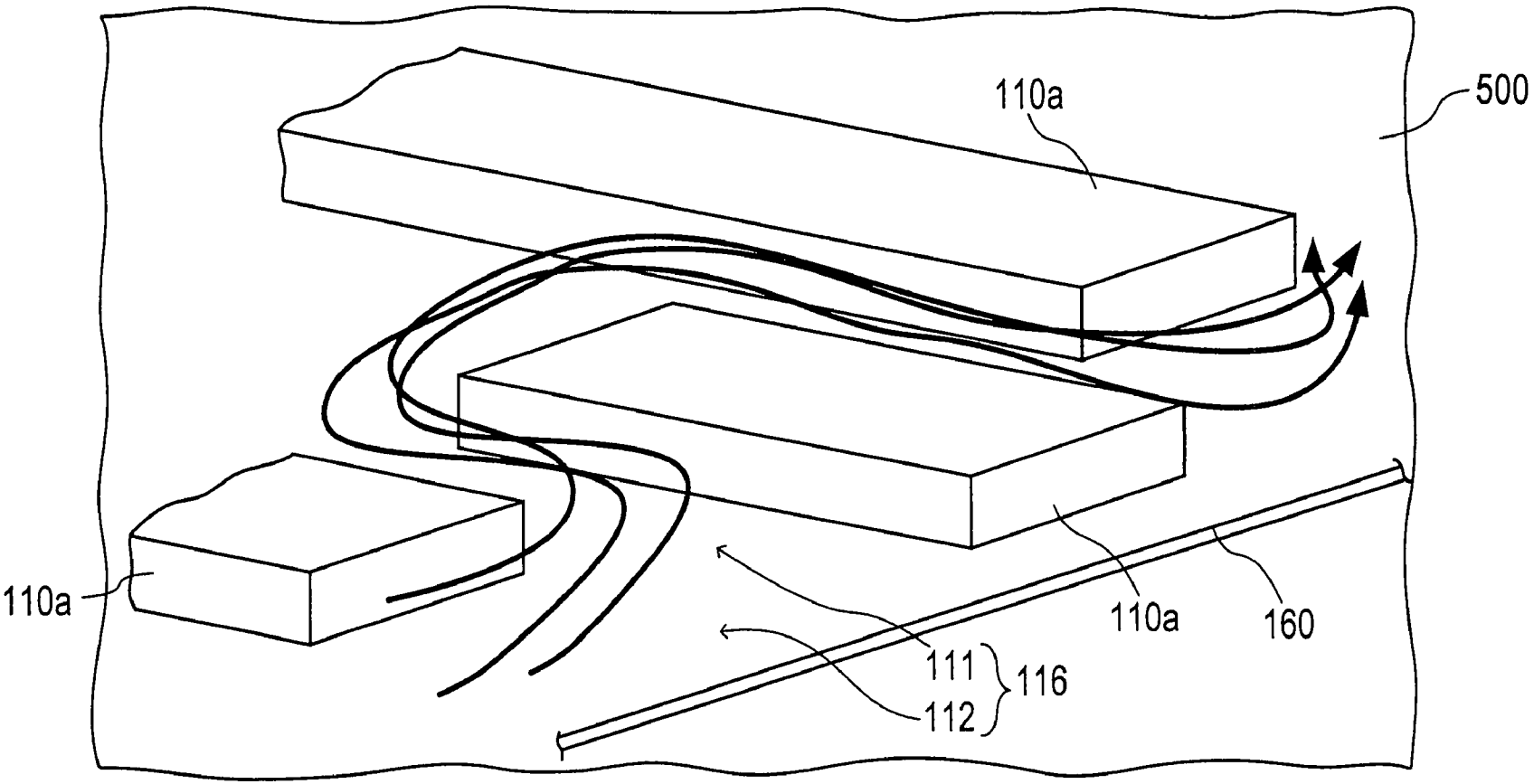
FIG. 8 is a perspective view showing disappearing of ink mists due to mist eduction paths.

According to the mist eduction paths 116 as mentioned above, spaces extending along the primary sweeping direction and the secondary sweeping direction as shown in FIG. 8 are formed around the ink heads 110*a*. Since the primary flow paths 111 and the secondary flow paths 112 are communicated each other in a retiform manner, ensured are airflow paths for disappearing ink mists made on printing.

Figure 7B:
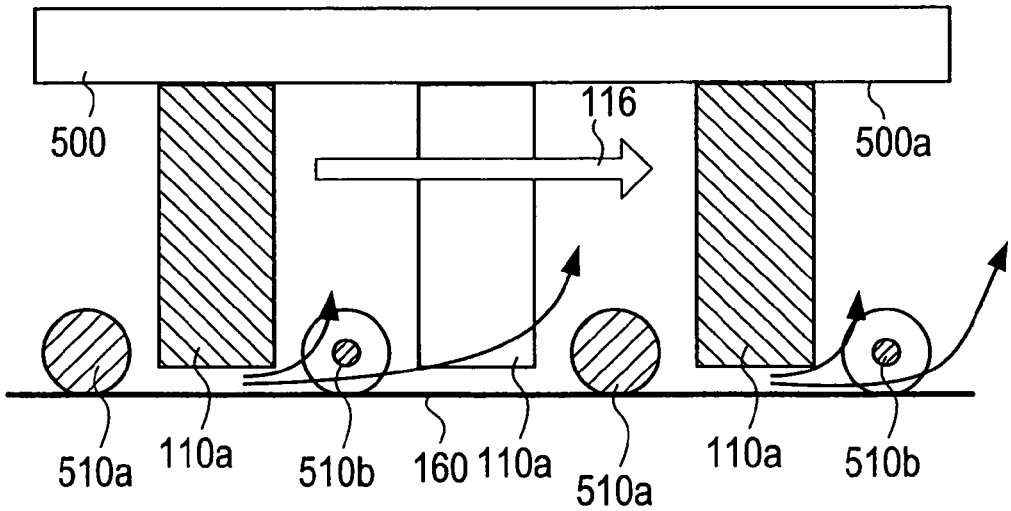
FIG. 7B is a schematic diagram showing the ink mist flows around the ink heads viewed from side.

Since the projecting height H of the ink heads 110*a* from the head holder surface 500*a* is made larger than the width L of the primary flow paths 111 in the present embodiment, spaces can be ensued between the ink injection plane of the ink heads 110*a* and the head holder surface 500*a*. Therefore, ink mists injected from the ink heads 110*a* are diffused by air pressure, as shown in FIG. 7B. As a result, it is prevented that the ink mists attach onto the head holder 500 or the ink heads 110*a*. Here, the stepped guide rollers 510 are provided in the primary flow paths 111 located upstream of the ink heads 110*a*. The ink mists are raised upward by the stepped guide rollers 510 (the upstream guide rollers 510*a* and the downstream guide rollers 510*b*) as shown in FIG. 7B and thereby the ink mists can be disappeared by airflow flowing through the mist eduction paths 116.

The stepped guide rollers 510 are made by integrating the upstream guide rollers 510*a* each having a large outer diameter and the downstream guide rollers 510*b* each having a smaller outer diameter than the large outer diameter of the upstream guide rollers 510*a*. The upstream guide rollers 510*a* are located upstream of the ink heads 110*a* along the feeding direction, respectively. The upstream guide rollers 510*a* are urged downward to rotate with being pressed onto the upper plane of the feeding path. On the other hand, the downstream guide rollers 510*b* are located downstream of the ink heads 110*a*, respectively. The downstream guide rollers 510*b* are made distanced from the upper plane of the feeding path so as not to contact on the upper plane of the feeding path. Therefore, ink mists made at an upstream ink head 110*a* are flows through the downstream guide roller 510*b* having a smaller outer diameter as shown in FIG. 7B. Since an upstream guide roller 510*b* located downstream rotates with being pressed onto the upper plane of the feeding path, its rotational speed is kept constant due to sliding on the platen belt 160. The ink mists are raised upward due to the rotation of the upstream guide roller 510*b* and thereby the ink mists can be disappeared by airflow flowing through the mist eduction paths 116.

What is claimed is:

1. An image forming apparatus for a printer which forms images by injecting inks on a printing paper being fed on a feeding path, the apparatus comprising:

a head holder surface provided on the feeding path with being opposed to a surface of the feeding path; and a plurality of ink heads for injecting inks from injection ports thereof, wherein the injection ports of the plurality of ink heads are projected outward from the head holder surface the plurality of the ink heads is aligned along a direction perpendicular to a feeding direction to form a plurality of columns, the plurality of the ink heads is aligned in a staggered manner, the plurality of columns is aligned at predetermined intervals to form primary flow paths therebetween so as not to overlap each other, the primary flow paths extending along the direction perpendicular to the feeding direction, the ink heads in each column are aligned at predetermined intervals to form secondary flow paths therebetween so as to overlap the ink heads in the each column with the ink heads in other columns adjacent to the each column along the feeding direction, and the primary flow paths and the secondary flow paths are communicated with each other to form retiform mist eduction paths.

2. The image forming apparatus according to claim 1, wherein a projecting height of the plurality of the ink heads from the head holder surface is made larger than a width of the primary flow paths.

3. The image forming apparatus according to claim 1, wherein a plurality of guide rollers is provided in the primary flow paths, the plurality of guide rollers being positioned upstream the plurality of ink heads along the feeding direction, respectively, and rotated with being pressed onto an upper surface of the feeding path.

4. The image forming apparatus according to claim 3, further comprises an ink head holder having the head holder surface at its bottom face, wherein the plurality of ink heads is held by the ink head holder with the injection ports being projected outward from the head holder surface, and the plurality of guide rollers is rotatably supported by the ink head holder.

5. An image forming apparatus for a printer which forms images by injecting inks on a printing paper being fed on a feeding path, the apparatus comprising:

a head holder surface provided on the feeding path with being opposed to a surface of the feeding path;

a plurality of ink heads for injecting inks from injection ports thereof;

a belt provided along the feeding path for feeding a printing paper, an upper surface of the belt being opposed to the head holder surface, wherein the injection ports of the plurality of ink heads are projected outward from the head holder surface, a plurality of belt holes is formed on the belt and the printing paper is suctioned on the upper surface of the belt due to negative pressure generated beneath the belt via the plurality of belt holes, the plurality of the ink heads is aligned along a direction perpendicular to the feeding direction to form a plurality of columns, the plurality of the ink heads is aligned in a staggered manner, the plurality of columns is aligned at predetermined intervals to form primary flow paths therebetween so as not to overlap each other, the primary flow paths extending along the direction perpendicular to the feeding direction, the ink heads in each column are aligned at predetermined intervals to form secondary flow paths therebetween so as to overlap the ink heads in the each column with the ink heads in other columns adjacent to the each column along the feeding direction, and the primary flow paths and the secondary flow paths are communicated with each other to form retiform mist eduction paths.

6. The image forming apparatus according to claim 5, wherein a projecting height of the plurality of the ink heads from the head holder surface is made larger than a width of the primary flow paths.

7. The image forming apparatus according to claim 5, wherein a plurality of guide rollers is provided in the primary flow paths, the plurality of guide rollers being positioned upstream the plurality of ink heads along the feeding direction, respectively, and rotated with being pressed onto an upper surface of the feeding path.

8. The image forming apparatus according to claim 7, further comprises an ink head holder having the head holder surface at its bottom face, wherein the plurality of ink heads is held by the ink head holder with the injection ports being projected outward from the head holder surface, and the plurality of guide rollers is rotatably supported by the ink head holder.

9. An image forming apparatus for a printer which forms images by injecting inks on a printing paper being fed on a feeding path, the apparatus comprising:

a head holder surface provided on the feeding path with being opposed to a surface of the feeding path; and a plurality of ink heads for injecting inks from injection ports thereof, wherein the injection ports of the plurality of ink heads are projected outward from the head holder surface the plurality of the ink heads is aligned along a direction perpendicular to a feeding direction to form a plurality of columns, the plurality of the ink heads is aligned in a staggered manner, the plurality of columns is aligned at predetermined intervals to form primary flow paths therebetween so as not to overlap each other, the primary flow paths extending along the direction perpendicular to the feeding direction, and a projecting height of the plurality of the ink heads from the head holder surface is made larger than a width of the primary flow paths.

10. The image forming apparatus according to claim 9, wherein a plurality of guide rollers is provided in the primary flow paths, the plurality of guide rollers being positioned upstream the plurality of ink heads along the feeding direction, respectively, and rotated with being pressed onto an upper surface of the feeding path.

11. The image forming apparatus according to claim 10, wherein each of the plurality of guide rollers is a stepped guide roller that is formed by alternately integrating upstream guide rollers and downstream guide rollers on a single rotational axis, each of the upstream guide rollers having a large outer diameter, and each of the downstream guide rollers having a smaller outer diameter than the large outer diameter of the upstream guide rollers, the upstream guide rollers are located upstream of the ink heads along the feeding direction, respectively, and urged downward to rotate with being pressed onto the upper surface of the feeding path, and the downstream guide rollers are located downstream of the ink heads along the feeding direction, respectively, and rotatably supported with being made distanced from the upper surface of the feeding path.

* * * * *